US008844224B2

(12) United States Patent
Lindquist

(10) Patent No.: US 8,844,224 B2
(45) Date of Patent: Sep. 30, 2014

(54) UTILITY DOWEL BRACKET

(71) Applicant: James Scot Lindquist, North Mankato, MN (US)

(72) Inventor: James Scot Lindquist, North Mankato, MN (US)

( * ) Notice: Subject to any disclaimer, the term of this patent is extended or adjusted under 35 U.S.C. 154(b) by 0 days.

(21) Appl. No.: 13/754,448

(22) Filed: Jan. 30, 2013

(65) Prior Publication Data

US 2013/0283724 A1 Oct. 31, 2013

Related U.S. Application Data

(60) Provisional application No. 61/687,690, filed on Apr. 30, 2012.

(51) Int. Cl.

| | |
|---|---|
| ***E04B 2/00*** | (2006.01) |
| ***E04G 11/06*** | (2006.01) |
| ***E04C 5/16*** | (2006.01) |
| ***E04G 13/00*** | (2006.01) |
| ***E04G 21/18*** | (2006.01) |
| ***E04G 21/02*** | (2006.01) |

(52) U.S. Cl.

CPC . *E04C 5/16* (2013.01); *E04C 5/166* (2013.01); *E04G 13/00* (2013.01); *E04G 21/185* (2013.01); *E04G 21/02* (2013.01)

USPC ..... 52/294; 52/677; 52/686

(58) Field of Classification Search

USPC ..... 52/415, 426, 677, 680, 681, 686, 687, 52/689, 294, 588; D25/199; D8/354

See application file for complete search history.

(56) References Cited

U.S. PATENT DOCUMENTS

| | | | | |
|---|---|---|---|---|
| 874,151 | A * | 12/1907 | Zeiser | 269/43 |
| 1,613,351 | A * | 1/1927 | Klinger et al. | 404/135 |
| 2,019,793 | A | 11/1935 | Oelfke | |
| 2,783,697 | A | 12/1953 | Eisner et al. | |
| 3,242,830 | A | 3/1966 | Crone | |
| 4,343,399 | A | 8/1982 | Patel et al. | |
| 4,493,584 | A | 1/1985 | Guntert | |
| 4,598,523 | A * | 7/1986 | Tolliver | 52/685 |
| 4,640,063 | A | 2/1987 | Ayala | |
| 4,840,527 | A | 6/1989 | Gschwend et al. | |
| 5,088,851 | A | 2/1992 | Hutter | |
| 5,263,676 | A * | 11/1993 | Medlin et al. | 248/300 |
| 5,678,952 | A | 10/1997 | Shaw et al. | |
| 5,713,174 | A | 2/1998 | Kramer | |
| 5,797,231 | A | 8/1998 | Kramer | |
| 5,867,960 | A | 2/1999 | Andra et al. | |
| 6,052,962 | A | 4/2000 | Ghali et al. | |
| 6,171,016 | B1 | 1/2001 | Pauls et al. | |
| D444,244 | S | 6/2001 | McPherson et al. | |
| 6,447,203 | B1 | 9/2002 | Ruiz et al. | |
| 6,526,721 | B1 * | 3/2003 | Nash | 52/677 |
| 6,591,574 | B2 | 7/2003 | Humphrey | |
| 6,612,085 | B2 | 9/2003 | Edwards et al. | |
| 6,692,184 | B1 | 2/2004 | Kelly et al. | |
| 6,990,774 | B2 * | 1/2006 | Clapp | 52/294 |

(Continued)

*Primary Examiner* — William Gilbert
*Assistant Examiner* — Alp Akbasli
(74) *Attorney, Agent, or Firm* — Merchant & Gould PC

(57) ABSTRACT

A dowel bracket is used for concrete wall or masonry wall construction. A rebar support bracket includes an elongated vertical member. The elongated vertical member has a first edge and an opposing second edge, where the first edge defines recesses. The rebar support bracket further includes a horizontal member projecting perpendicularly at a lower end of the elongated vertical member making an angled portion. The horizontal member has a planar surface that defines at least one mounting aperture provided to mount the rebar support bracket.

4 Claims, 5 Drawing Sheets

(56) References Cited

U.S. PATENT DOCUMENTS

| | | | | |
|---|---|---|---|---|
| 7,201,535 | B2 | 4/2007 | Kramer | |
| 7,222,293 | B1 | 5/2007 | Zapiec et al. | |
| 7,404,691 | B2 | 7/2008 | Bennett et al. | |
| 7,441,984 | B2 | 10/2008 | Kramer | |
| 7,444,789 | B1 * | 11/2008 | Moore | 52/426 |
| 7,905,680 | B2 | 3/2011 | Albritton et al. | |
| 8,182,179 | B2 | 5/2012 | Bohnhoff | |
| 8,220,219 | B2 | 7/2012 | Martter | |
| 8,322,109 | B2 * | 12/2012 | Trangsrud | 52/686 |
| 2006/0188336 | A1 | 8/2006 | Huber | |
| 2006/0201746 | A1 * | 9/2006 | Jackson | 182/204 |
| 2009/0100784 | A1 * | 4/2009 | Garza et al. | 52/686 |
| 2009/0249725 | A1 * | 10/2009 | McDonagh | 52/378 |
| 2010/0180534 | A1 * | 7/2010 | Kleinsasser | 52/665 |
| 2010/0300033 | A1 * | 12/2010 | Trangsrud | 52/685 |
| 2011/0047915 | A1 * | 3/2011 | Waters et al. | 52/414 |
| 2011/0072751 | A1 * | 3/2011 | Clear et al. | 52/415 |
| 2011/0099932 | A1 * | 5/2011 | Saulce | 52/426 |
| 2011/0179736 | A1 * | 7/2011 | Waldron | 52/426 |
| 2011/0214382 | A1 * | 9/2011 | Alfonso | 52/687 |
| 2011/0219721 | A1 * | 9/2011 | Densmore | 52/687 |
| 2011/0314760 | A1 * | 12/2011 | Degen et al. | 52/426 |

* cited by examiner

UTILITY DOWEL BRACKET

CROSS REFERENCE TO RELATED APPLICATION

The present application claims priority to U.S. Provisional Patent Application Ser. No. 61/687,690, filed on Apr. 30, 2012, which is entitled "REBAR DOWEL SUPPORT BRACKET."

FIELD OF THE INVENTION

The present invention relates to a system and a method of using a dowel bracket for concrete foundations.

BACKGROUND

In the art of building construction it is common practice to cast the base or foundation with concrete. Cast-in-place concrete walls or masonry walls are commonly constructed by using concrete forms. Concrete forms act as molds to shape and support concrete until the concrete cures sufficiently to stand without the forms. These concrete forms are typically made from wood, metal or plastic, and can range in height from 4 inches to many feet. Wood forms are often plywood or oriented strand board (OSB. It is common practice for contractors to reuse wood forms in multiple projects. Reusable wood forms are acceptable until they become too flexible to hold the concrete at the right lines. One drawback is that the surfaces of reusable wood forms are required to be checked closely for old concrete and surface defects, which can become burdensome and time consuming.

A conventional wood form consists of assemblies of about 4 ft by 8 ft plywood sheets that have been braced vertically by studs and horizontally by spreader bars. A contractor typically uses wood form panels to erect and position a panel on each side of an identified frame to construct the formwork. The panels are typically held in place with 2×4 members or studs against the ground. Contractors most commonly attach these panels to the footboards with screws or nails. In addition to having the wood form panels and footboards, a contractor may also use 2×4 spreaders and/or struts to maintain the interior dimension of the formwork. The spreaders are used most often in tall, narrow wall forms. These spreaders are mostly placed across the wood form panels and nailed thereon to create multiple cavities within the formwork and to construct a temporary frame for pouring the concrete.

In constructing a concrete or masonry wall, contractors place reinforcing rebar inside the wood forms. The reinforcing rebar is laid along the bottom of the formwork and is usually spaced apart slightly from the ground and a grid extends throughout the foundation and walls. The reinforcing steel is commonly held in place by fastening the bars with approved wire ties. In addition to the steel, dowels or vertical bars are commonly used to connect sections of the substructure together, forming an integral unit. These dowels tie a footing into a wall or column. The bottom ends of the dowel are typically L-shaped and become embedded in the formwork when the concrete is poured for the foundation. The dimensions of the dowels may vary upon the type and size of the wall or column being constructed.

An ongoing concern in concrete construction is maintaining the rebar dowels embedded in the foundation and extending from the upper surface in the proper position and orientation during a concrete pour. To help address this problem, contractors have attached additional 2×4's across the spreader bars used to maintain the interior dimensions of the form to support the dowels. The wood forms are typically nailed to the spreader bars. A contractor can then tie the dowels to the wood forms using a nail and bending the nail around the dowel such that the dowel is secured to the wood form. The additional pieces of plywood help provide a structure to support the dowels. Once the concrete is poured, it is allowed to cure before any further work is performed. Therefore, horizontal reinforcement bars are not installed on the dowels until after a several hours of curing the concrete. Therefore, one drawback to this process is the delay in the installation while waiting for the concrete to cure, which can take at least a couple of hours. Another drawback to this construction process is the amount of wood material wasted because of defects in the wood resulting from concrete exposure. Another drawback is the time consuming and laboring consuming tasks of removing and attaching nails from all the wood form during installation and demolition of the formwork.

There is a need for a much simpler process for constructing concrete walls or masonry walls that requires less demolition and installation time. There is a need for a system that allows for horizontal reinforcement bars to be installed on embedded vertical elements without having to wait hours for concrete to cure. There is a need for a system that produces less waste material when constructing a concrete foundation. The present invention addresses these as well as other problems associated with concrete foundations and walls.

SUMMARY

In general terms, the present invention is directed to a system and a method of using dowel brackets for concrete walls or masonry walls. In one possible configuration, and by non-limiting example, the dowel bracket is L-shaped. The dowel bracket is arranged and configured to mount to a spreader bar. The dowel bracket is used to install horizontal reinforcing bars before the concrete is poured. The process allows for the horizontal reinforcing bars to be installed without having to wait until the concrete is cured thereby saving time. In other embodiments, the dowel bracket is planar and can be attached along the side of the framework to support additional horizontal reinforcing bars. The method of using the dowel brackets helps to simplify the process and reduces time required for constructing concrete walls or masonry walls.

A rebar support bracket includes an elongated vertical member. The elongated vertical member has a first edge and an opposing second edge, where the first edge defines spaced apart recesses. The rebar support bracket further includes a horizontal member projecting perpendicularly at a lower end of the elongated vertical member making an angled portion. The horizontal member has a planar surface that defines at least one mounting aperture provided to mount the rebar support bracket.

A method of making a reinforcing bar assembly for a concrete or masonry wall having rebar support brackets includes erecting a foundation frame, the foundation frame includes side members and spreader bars. The side members are reinforced by support members extending perpendicularly to the side members and each of the spreader bars are spaced apart and mounted across the side members and forming a foundation frame configured to receive poured cement. The method further includes placing footing reinforcements at a base of the foundation frame extending along the side members. One of the rebar support brackets mounts onto each of the spreader bars by inserting a fastener through at least one aperture located on a horizontal member of the rebar support brackets to secure one of the rebar support brackets on each of the spreader bars. A rebar reinforcing bar is placed horizontally along the rebar support brackets to be received within and supported by one of the recesses defined along an elongated vertical member of each of the rebar support brackets. Vertical rods extend perpendicularly along the horizontal reinforcing bar and cement is poured into the foundation frame. The concrete is allowed to cure so that the foundation frame and the rebar support brackets can be removed.

A rebar support system includes rebar support brackets. Each of the rebar support brackets includes a main body having a first edge and an opposing second edge, where the first edge defines recesses. Each of the rebar support brackets include a flange member extending perpendicularly from the main body at a lower end making an angled portion. The flange member has a planar surface defining at least one mounting aperture provided to mount the rebar support bracket. Each of the rebar support brackets further include a fastener configured to be received in the at least one mounting aperture of the flange and mount to a spreader bar. Each of the spreader bars is provided to mount one of the rebar support brackets thereon. A horizontal reinforcing bar extends along the rebar support brackets, and is configured to be received within and supported by one of the recesses of each of the rebar support brackets, and to be secured thereto. Dowels attach to the horizontal reinforcing bar and each of the dowels has a lower end extending beneath a plane of one of the spreader bars and into the concrete base.

DETAILED DESCRIPTION

Figure 1:
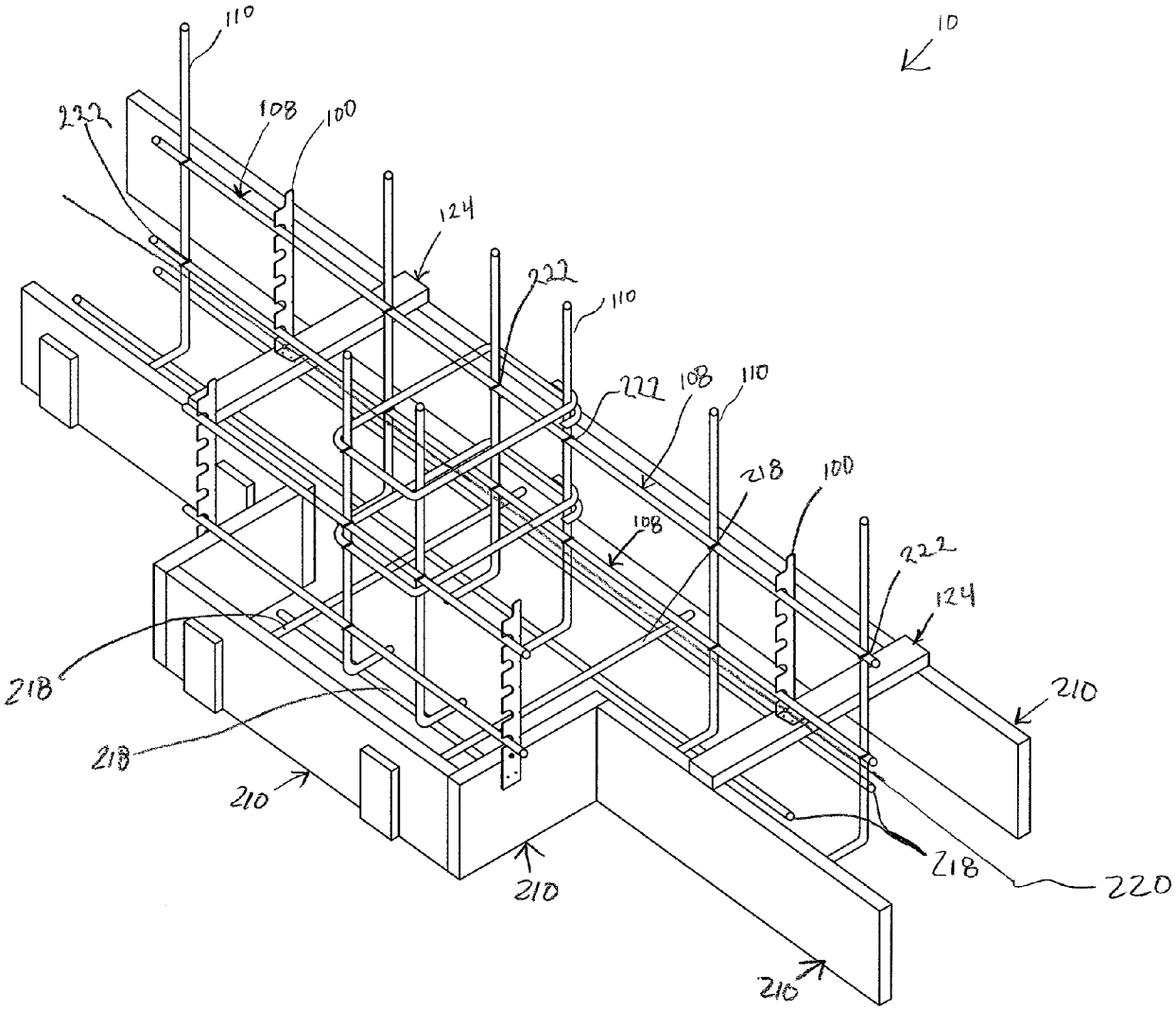
FIG. 1 shows a perspective view of a concrete construction assembly with dowel brackets installed in accordance with the principles of the present invention.

Various embodiments will be described in detail with reference to the drawings, wherein like reference numerals represent corresponding parts and assemblies throughout the several views. Reference to various embodiments does not limit the scope of the claims attached hereto. Additionally, any examples set forth in this specification are not intended to be limiting and merely set forth some of the many possible embodiments for the appended claims.

A concrete foundation for constructing a concrete wall or masonry wall may be built according to known practices, such as, with wood form materials, steel rebar, and dowels embedded in the foundation. Panels of wood form are constructed together on the ground surface to provide footers for the foundation. The footers are supported vertically by 2×4 pieces or plywood, which are typically nailed to the footers. The footers are also supported horizontally with 2×4 spreaders that are also pieces of plywood nailed to the footers. The sizes and dimensions of the footers and spreaders vary with the configuration and requirements of the wall structure being constructed. Together the pieces of wood forms make a formwork for concrete walls or masonry walls. Rebar reinforcements are placed inside the interior of the formwork and are raised a distance off the ground and located in the center of the wood forms.

Unlike prior systems, the system of the present invention does not utilize additional wood forms for the installation of dowels to be embedded in the foundation. According to the present invention, dowel brackets are installed and attached on top of the 2×4 spreader bars. The dowel bracket may be a piece of sheet metal that can be easily reused in a multitude of projects. The dowel brackets can be easily aligned through a view hole located at a center of the dowel bracket. The view hole is used to center all the dowel brackets on a chalk line. Once the dowel brackets are attached to the formwork, the system of the present invention provides for horizontal reinforcement bars to be attached directly onto the dowel brackets. Unlike traditional systems where additional 2×4 elements are used to support dowels in cured concrete prior to the installation of horizontal reinforcement bars, the present invention allows for the horizontal reinforcement bars to be installed in advance of installing the dowels and prior to pouring concrete. The dowels are then installed and tied directly to the horizontal reinforcement bars followed by pouring of the concrete. With the present invention, a contractor would save hours by not having to wait for the concrete to cure because the horizontal reinforcement bars are already installed and ready to support vertical reinforcing wall steel.

Figure 2:
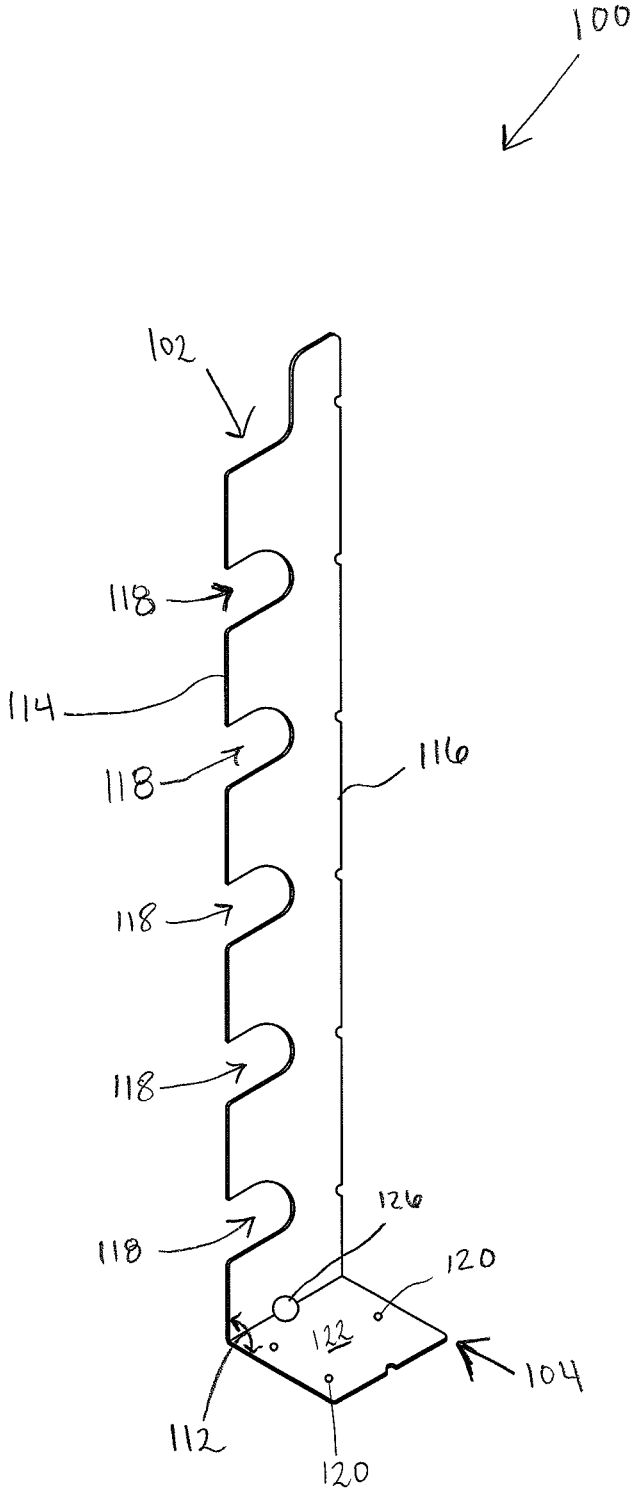
FIG. 2 shows a perspective view of a heavy duty dowel bracket in accordance with the principles of the present invention.

FIG. 1 is a perspective view of a first embodiment of a concrete construction assembly 10 including a heavy duty dowel bracket 100 and a light duty dowel bracket 200. The heavy duty dowel bracket 100 generally includes an elongated vertical member 102 and a horizontal member 104, as shown more clearly in FIG. 2. The heavy duty dowel bracket 100 can be supported on top of a form wall or foundation frame 106 in order to hold a series of horizontal reinforcing bars 108. The heavy duty dowel bracket 100 can easily be installed and use of the brackets 100 may significantly reduce the time and expense of constructing a concrete vertical wall.

The elongated vertical member 102 may be considered the main body of the heavy duty dowel bracket 100. The horizontal reinforcing bars 108 help to support and align the vertical rods 110 prior to pouring the footing. The elongated vertical member 102 of the heavy duty dowel bracket 100 can support the horizontal reinforcing bars 108 at various distances above the footing. The elongated vertical member 102 is illustrated and described in more detail with reference to FIG. 2.

The horizontal member 104 may be considered a flange member of the heavy duty dowel bracket 100. The horizontal member 104 extends adjacent to the elongated vertical member 102 and directly attaches to the foundation frame 106 for a concrete or masonry wall. In some embodiments, the horizontal member 104 is connected to the elongated vertical member 102 creating an angled portion 112 between the two. The angled portion 112 can form a 90 degree angle.

Figure 3:
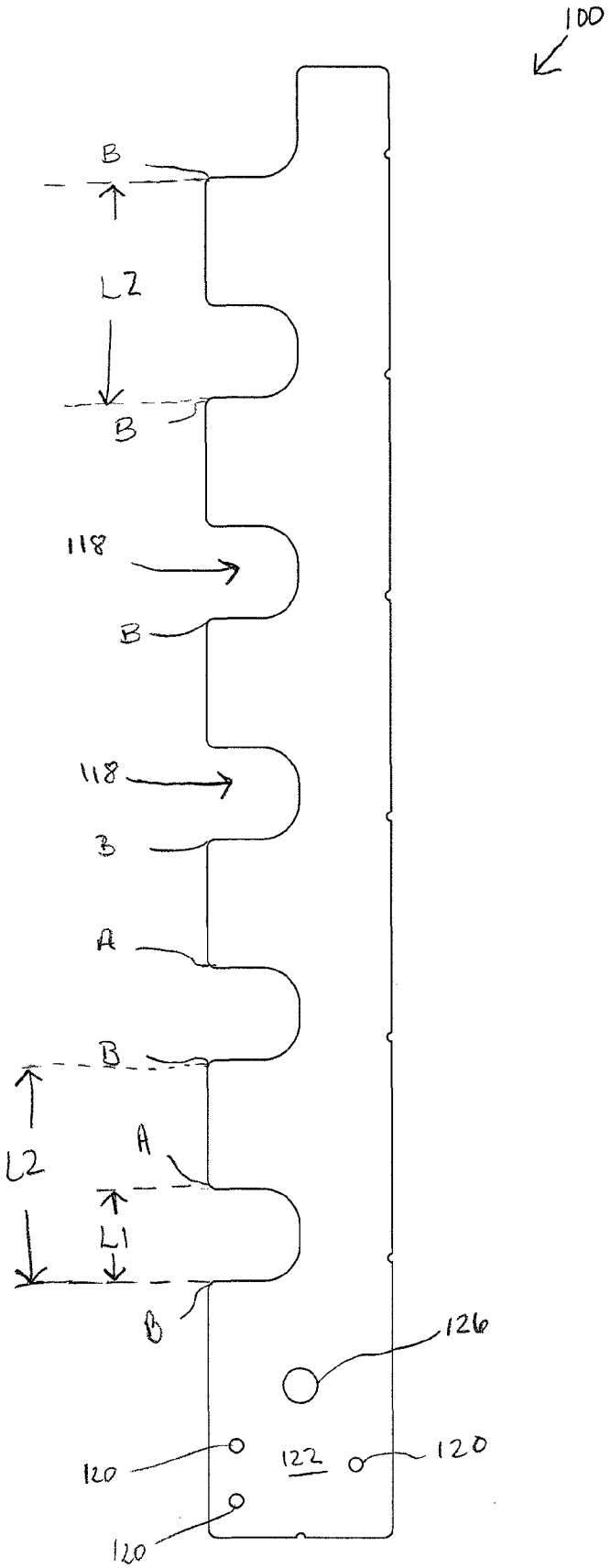
FIG. 3 shows a front planar view of the heavy duty dowel bracket shown in FIG. 2.

The elongated vertical member 102 includes a first edge 114 and an opposing second edge 116. The first edge 114 defines a series of recesses 118. In the embodiment shown, the elongated vertical member 102 has five recesses 118. In other embodiments, the elongated vertical member 102 may include any number of recesses 118. Each of the recesses 118 can have a first length L1 measured between point A and point B along the first edge 114 of the heavy duty dowel bracket 100, as shown in FIG. 3. In the embodiment shown, the first length L1 is about 1.25 inches. In other embodiments, the first length L1 can vary to be longer or shorter.

Each of the recesses 118 has a point B that measures a second length L2 from one of the other recesses 118 at point B. In the embodiment shown, the second length L2 is about three inches. It is to be understood that the second length can vary. The locations of the recesses 118 provides for the heavy duty dowel bracket 100 to hold the horizontal reinforcing bars 108 at about 3 inches, 6 inches, 9 inches, 12 inches, 15 inches and 18 inches above the footing. In the embodiment shown, the width of the heavy duty dowel bracket 100 is about 2.5 inches between the first edge 114 and the second edge 116. It is to be understood that other widths may also be used.

The horizontal member 104 of the heavy duty dowel bracket 100 defines mounting apertures 120 located in a planar region 122 of the horizontal member 104. As shown, three mounting apertures 120 are configured, but other configurations may be used. Two of the mounting apertures 120 are configured to be about 0.75 inches apart. The third aperture 120 is centered between the other two mounting apertures 120 measuring about an inch from the angled portion 112 to the center. It is to be understood that the configuration and arrangement of the mounting apertures 120 may vary. The mounting apertures 120 can be used to fix the heavy duty dowel bracket 100 to a support structure such as, but not limited to, spreader bars 124. The heavy duty dowel bracket 100 can be fixed through the mounting apertures 120 by a fastener, such as, but not limited to, a screw or nail (not shown). It is to be understood that other fasteners may be used, for example, a threaded fastener, a thumbscrew, a pin, a bolt, a dowel, a latch, a collet, a nail and the like.

The heavy duty dowel bracket 100 may further define a view hole 126. The view hole 126 may be used with a snap chalk line to help align the heavy duty dowel brackets 100 in the concrete construction assembly 10. In the embodiment shown, the view hole 126 is centered in the angled portion 112 of the heavy duty dowel bracket 100 and has an equal distance between the first edge 114 and the opposing second edge 116 of the heavy duty dowel bracket 100.

Figure 4:
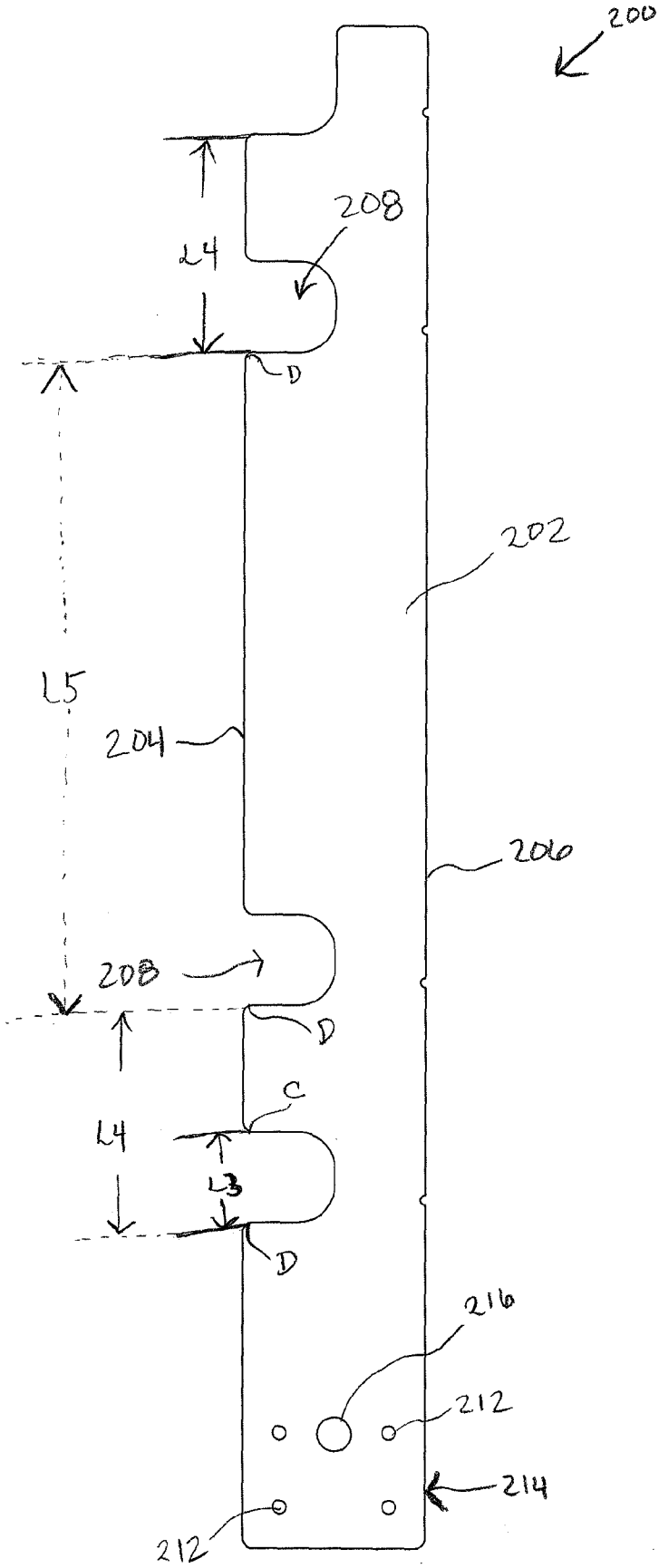
FIG. 4 is a front planar view of a light duty dowel bracket in accordance with the principles of the present invention.

FIG. 4 is a perspective view of a light duty dowel bracket 200. The light duty dowel bracket 200 includes an elongated planar member 202. In this embodiment, the elongated planar member 202 includes a first edge 204 and an opposing second edge 206. As shown, the first edge 204 defines at least one recess 208. The recess 208 has a third length L3 measured between point C and point D. The third length L3 can be about 1.25 inches. It is to be understood that the third length L3 may vary. The distance between point D of the recess 208 and point D of another recess is indicated by fourth length L4 and fifth length L5, as shown. In this embodiment, the distance between the recess 208 and another recess may be a minimum of about three inches and a maximum of about twelve inches. It is to be understood that the length of distances indicated in FIG. 4 may vary.

The light duty dowel bracket 200 can be attached to footing forms 210 for easy installation of the horizontal reinforcing bars 108. The recess 208 of the light duty dowel bracket 200 is arranged and configured to hold the horizontal reinforcing bars 108 at a distance of about 3 inches and about 12 inches above the footing.

The light duty dowel bracket 200 further includes apertures 212 located at a lower end 214 of the elongated planar member 202. The apertures 212 may be used to mount the light duty dowel bracket 200 to the footing forms 210 with a fastener such as, but not limited to, a screw or nail (not shown). It is to be understood that other fasteners may be used, for example, a threaded fastener, a thumbscrew, a pin, a bolt, a dowel, a latch, a collet, a nail and the like.

The light duty dowel bracket 200 may further define an opening 216 located at the lower end 214 of the light duty dowel bracket 200. The opening 216 is centered an equal distance between the first edge 204 and the opposing second edge 206 of the light duty dowel bracket 200 in the embodiment shown. The opening 216 may be used with a snap chalk line to help align the light duty dowel brackets 200 in a concrete construction assembly 10.

Referring again to FIG. 1, the heavy duty dowel bracket 100 and the light duty dowel bracket 200 are assembled in a concrete construction assembly 10 to provide support of the horizontal reinforcing bars 108.

Figure 5:
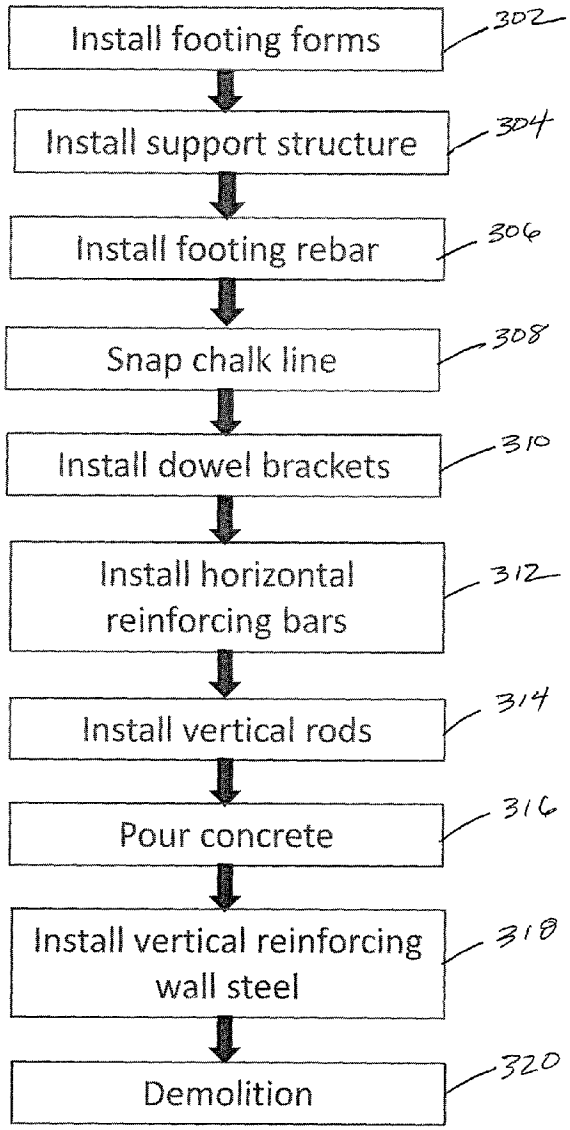
FIG. 5 shows a flow chart illustrating a method of making a reinforcing bar assembly for a concrete or masonry wall having a plurality of rebar support brackets in accordance with the principles of the present invention.

FIG. 5 is a flow chart illustrating an example method 300 of making a reinforcing bar assembly for a concrete or masonry wall. The method 300 includes operations 302, 304, 306, 308, 310, 312, 314, 316, 318, and 320.

The operation 302 is performed to install the footing forms 210. The footing forms 210 can be 2×12 inch plywood staked into the ground. The footing forms 210 can be configured with various dimensions and depths relative to the ground. An example of the footing forms 210 is shown with reference to FIG. 1.

The operation 304 is performed to install the support structure, such as, but not limited to, spreader bars 124. An example of the spreader bars 124 is illustrated in FIG. 1. In this embodiment, the spreader bar 124 may be 2×4 spreader bars 124 centered at about 4 to 5 feet relative to the footing forms 210.

The operation 306 is performed to install footing rebar 218. The footing rebar 218 can be ½ inch in diameter rebar or some other dimension. The footing rebar 218 may be suspending throughout the footing forms 210. The footing rebar 218 typically is centered top to bottom in the footing forms 210 and also spaced within the footing forms 210 as much as possible. The length of the footing rebar 218 may vary per construction project. It is to be understood that any length of footing rebar 218 may be used and cut or bent as needed. The footing rebar 218 may overlap for several feet and may be wire tied together whenever a splice is made. An example of the footing rebar 218 is shown with reference to FIG. 1.

The operation 308 is performed to create a snap chalk line 220 for dowel bracket installation. The snap chalk line 220 may be formed by adding the clearance distance of the rebar and the width of the horizontal rebar to snap the line from the edge of a concrete wall. An example of the snap chalk line 220 is illustrated in FIG. 1. The heavy duty dowel bracket 100 define a view hole 126, and the light duty dowel bracket 200 define an opening 216. The view hole 126 and openings 216 may be used with a snap chalk line to align the dowel brackets 100, 200 in a concrete construction assembly 10.

The operation 310 is performed to line up the dowel brackets by centering the brackets on the snap chalk line 220. The heavy duty dowel bracket 100 may be fixed to the support structure 124 as previously described above. The light duty dowel bracket 200 may be fixed to the footing forms 210 as previously described above. An example of a heavy and light duty dowel bracket 100, 200 installation is illustrated in FIG. 1.

The operation 312 is performed to install the first horizontal reinforcing bars 108 into the heavy duty dowel bracket 100 and the light duty dowel bracket 200. The horizontal reinforcing bars 108 can be installed in pairs. The horizontal reinforcing bars 108 may be supported in the recesses 118, 208 of the heavy and light duty dowel brackets 100, 200. The horizontal reinforcing bars 108 may be tied to the heavy and light duty dowel brackets 100, 200 with a connector (not shown), such as, but not limited to a wire. It is to be understood that other closures may be used, for example, snaps, clips, or retaining tabs.

The operation 314 is performed to install and tie vertical rods 110 directly to the horizontal reinforcing bars 108 prior to pouring concrete. The vertical rods 110 are typically L-shaped rods. The vertical rods 110 are tied to the horizontal reinforcing bars 108 with a tie 222, such as, but not limited to a wire. It is to be understood that other ties may be used, for example, snaps, clips, or retaining tabs. The operation 314 provides for a simpler process of installing vertical rebar rods 110 without having to pour blocking/concrete to hold the vertical rods 110. The operation 314 can help save time with the installation process. An example of the vertical rods 110 tied to the horizontal reinforcing bars 108 is illustrated in FIG. 1.

The operation 316 is performed to pour the concrete into the footing forms 210. The concrete can set for about two hours before attaching a vertical wall.

The operation 318 is performed to tie vertical reinforcing wall rebar to the horizontal reinforcing bars 108 and the vertical rods 110. The operation 318 of attaching the vertical reinforcing wall steel to the vertical rods 110 may be performed because the heavy and light duty dowel brackets 100, 200 support the weight of the horizontal reinforcing bars 108 on the spreader bars 124. This is a unique feature of the invention that saves time in the installation process.

The operation 320 is performed to remove the fasteners from the heavy and light duty dowel brackets 100, 200 in order to remove the heavy and light duty dowel brackets 100, 200, from the spreader bars 124. The spreader bars 124 and footing forms 210 are also removed. The operation 320 may have less demolition time with the easy installation and removal of the heavy and light duty dowel brackets 100, 200. In addition, the already installed horizontal reinforcing bars 108 and vertical rods 110 can put the construction work hours ahead.

While this invention has been particularly shown and described with references to preferred embodiments thereof, it will be understood by those skilled in the art that various changes in form and details may be made therein without departing from the scope of the invention encompassed by the appended claims. The drawings are not necessarily to scale, emphasis instead being placed upon illustrating the principles of the invention and other modifications within the scope. Any such modifications or variations that fall within the purview of this description are intended to be included therein as well. It is understood that the description herein is intended to be illustrative only and is not intended to be limitative.

What is claimed is:

1. A rebar support system for concrete construction, the system comprising:

a footer assembly including a plurality of horizontally extending spaced apart footing forms creating a formwork defining a volume for a footing of the concrete construction;

a plurality of rebar support brackets; each of the plurality of rebar support brackets comprising:

a main body having a first edge and an opposing second edge, wherein the first edge defines a plurality of recesses; and a flange member extending perpendicularly from the main body at a lower end making an angled portion, the flange member having a planar surface defining at least one mounting aperture provided to mount the rebar support bracket;

a fastener configured to be received in the at least one mounting aperture of the flange;

a plurality of spreader bars extending between upper edges of the spaced apart footing forms and over the volume for the footing, each of the plurality of rebar support brackets removably mounting the flange member to a corresponding one of the plurality of spreader bars and over the volume for the footing of the concrete construction;

a horizontal reinforcing bar extending along the plurality of rebar support brackets, and configured to be received within and supported by and secured to one of the plurality of recesses of each of the plurality of rebar support brackets; and a plurality of dowels attaching to the horizontal reinforcing bar, one or more of the plurality of dowels having a vertical section and a horizontal section, the horizontal section projecting substantially perpendicularly to the vertical section at a lower end thereof making an angled portion positioned beneath a plane of one of the plurality of spreader bars and within the volume for the footing of the concrete construction.

2. The system according to claim 1, further comprising an aperture located laterally in the middle of the angled portion having an equal distance between the first edge and the opposing second edge.

3. The system according to claim 1, further comprising additional horizontal reinforcing bars secured together to construct a wall.

4. The system according to claim 1, wherein the fastener is a threaded fastener, a thumb screw, a captive fastener, a pin, a bolt, a dowel, a rivet, a latch, or a wire tie.

* * * * *